US005672108A

United States Patent [19]

Lam et al.

[11] Patent Number: 5,672,108

[45] Date of Patent: Sep. 30, 1997

[54] ELECTRONIC GAME WITH SEPARATE EMITTER

[75] Inventors: Clive Lam, Kwun Tong, Hong Kong; Ralph F. Osterhout, San Francisco, Calif.

[73] Assignee: Tiger Electronics, Inc., Vernon Hills, Ill.

[21] Appl. No.: 586,589

[22] Filed: Jan. 16, 1996

[51] Int. Cl.[6] ..... A63F 9/02

[52] U.S. Cl. ..... 463/39; 463/51; 463/2

[58] Field of Search ..... 463/36, 37, 39, 463/47, 50, 51, 2; 545/158, 182

[56] References Cited

U.S. PATENT DOCUMENTS

| | | | |
|---|---|---|---|
| Re. 33,229 | 6/1990 | Schwaber | 345/156 |
| 3,789,136 | 1/1974 | Haith et al. | 178/5.8 R |
| 3,960,380 | 6/1976 | Yokoi | 463/51 |
| 4,807,031 | 2/1989 | Broughton et al. | 358/142 |
| 4,844,475 | 7/1989 | Saffer et al. | 463/50 |
| 5,369,432 | 11/1994 | Kennedy | 345/153 |
| 5,401,025 | 3/1995 | Smith, III et al. | 463/47 |
| 5,437,463 | 8/1995 | Fromm | 463/51 |
| 5,528,264 | 6/1996 | Kautzer et al. | 345/158 |

*Primary Examiner*—Jessica Harrison
*Assistant Examiner*—James Schaff
*Attorney, Agent, or Firm*—Fitch, Even, Tabin & Flannery

[57] ABSTRACT

An electronic game comprising an emitter unit and a target unit. The emitter unit can emit a beam of electromagnetic radiation of a particular wavelength. The target unit has a liquid crystal display and an electromagnetic radiation sensor for measuring the amount of electromagnetic radiation directed at it from the emitter. An electronic controller inside the target unit controls the flow of the game and receives input signals from the radiation sensor which affect the game.

6 Claims, 8 Drawing Sheets

ELECTRONIC GAME WITH SEPARATE EMITTER

BACKGROUND OF THE INVENTION

The present invention relates to electronic games, and more particularly to electronic games having liquid crystal display (LCD) user interfaces or other interfaces.

Electronic devices having an LCD user interface are employed in a wide variety of applications. Such applications include, for example, instrumentation and various entertainment uses. LCD devices are used extensively because of the relatively low cost associated with their use.

One common use for LCD devices is in small or hand-held video games. Such games tend to be less complex, and therefore lower in cost, than the larger games typically found in video arcades. Usually, these games are provided with manual input devices on the housing of the game, and the manual input devices are in direct contact with a circuit connected to the control chip of the game. These manual input devices may include buttons, joysticks, direction key pads, roller balls and the like.

The type of game being played generally dictates the most appropriate type(s) of input device. Other factors, such as the ergonomics and hardware cost associated with each type, may also affect the choice of input devices. The amount of realism incorporated into the "feel" of an electronic game often relates significantly to the success of the particular game. The degree to which the various available input devices approximate reality varies considerably. When the player of the game is required to navigate a spaceship, for example, a joystick may be satisfactory whereas a track ball, for example, might not be.

In one very popular type of electronic game the player attempts to survive and/or accomplish a simulated mission by using a simulation of a projectile-emitting weapon such as a gun or a bazooka. Typically, such a game scores the player based on his efficiency at striking specified targets and/or his ability to avoid being "injured" or "killed" by enemies.

A significant problem, however, with gun shooting in small electronic games is the manipulative clumsiness of the traditional input devices and their simultaneous inability to realistically simulate the "feel" of aiming and firing a gun. Some games have employed a track ball and button combination to permit one hand of the player to translate a crosshair printed on the display of the game while the other hand pressed a button to "fire" the gun. Others have employed a joystick-type device to permit the player to "steer" a crosshair while a button on top of the joystick could be depressed to "fire" the gun. Such input devices, however, do not closely approximate the action of firing a gun.

SUMMARY OF INVENTION

The inventive game offers an enhanced "feel" to the type of liquid crystal display game described above by providing a different type of input device which can better simulate the human kinesiology of aiming and firing a gun.

The inventive electronic game comprises an emitter unit and a target unit. The emitter unit can emit a beam of electromagnetic radiation of a particular wavelength. The target unit has a display and one or more electromagnetic radiation sensors for measuring the intensity of electromagnetic radiation directed at them from the emitter. An electronic controller controls the flow of the game and receives input signals from the radiation sensor or sensors.

In the preferred embodiment of the invention, described in detail below, the emitter unit is shaped like a gun and has a trigger for "shooting" the gun at targets appearing on the display. Thus, the inventive game better simulates and provides the look and feel of a gun-shooting game, eliminating the need for clumsy manual input devices in direct contact with the circuitry of the game.

DETAILED DESCRIPTION OF THE PREFERRED EMBODIMENTS

The inventive electronic game comprises an emitter unit and a target unit. The emitter unit emits a beam of electromagnetic radiation of a particular wavelength. The target unit has a liquid crystal display and one or more electromagnetic radiation sensors for measuring the amount of electromagnetic radiation directed at it from the emitter. An electronic controller inside the target unit controls the flow of the game and receives signals responsive to the radiation sensor.

Figure 1:
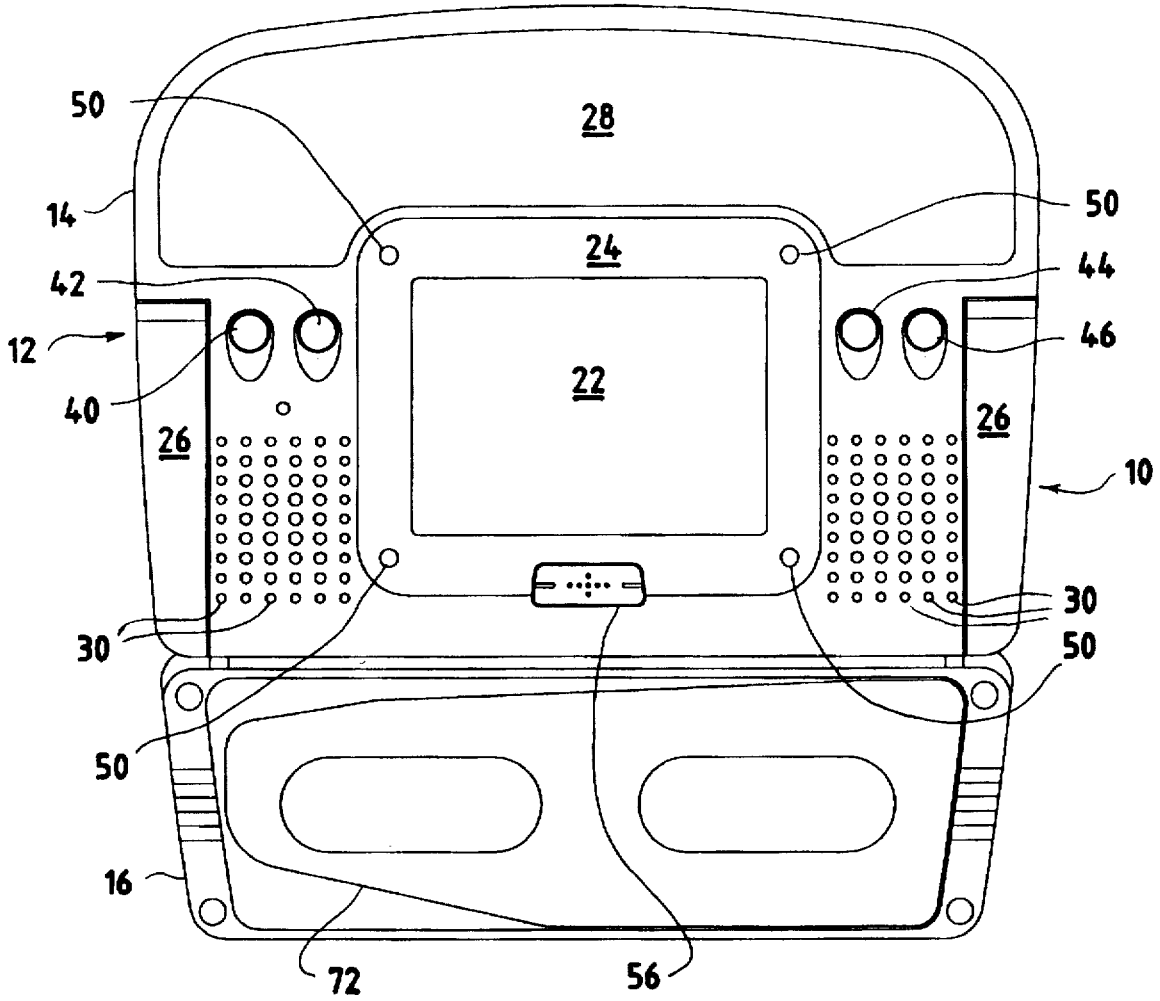
FIG. 1 is an exploded front view of an electronic game in accordance with the claimed invention.
Figure 1A:
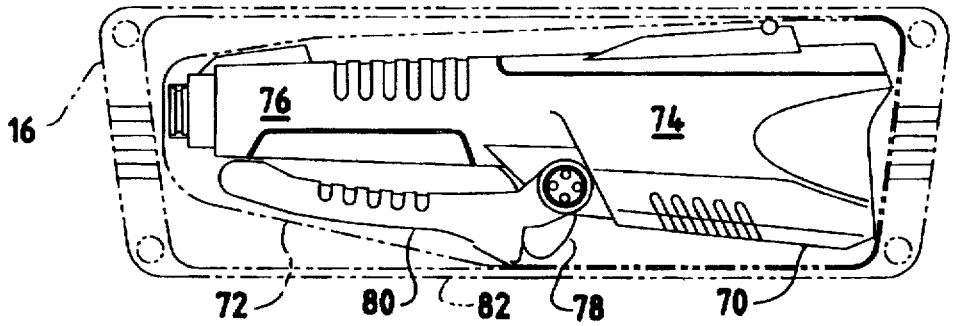
Figure 3:
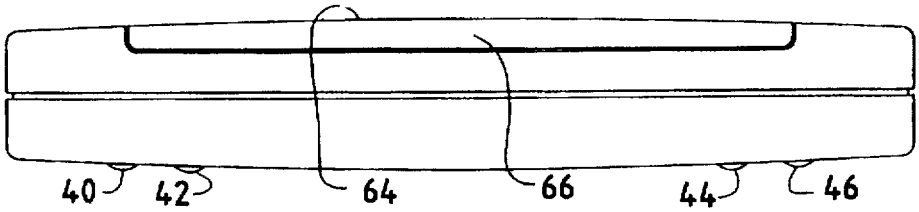
FIG. 3 is a top view of the electronic game of FIG. 1.
Figure 2:
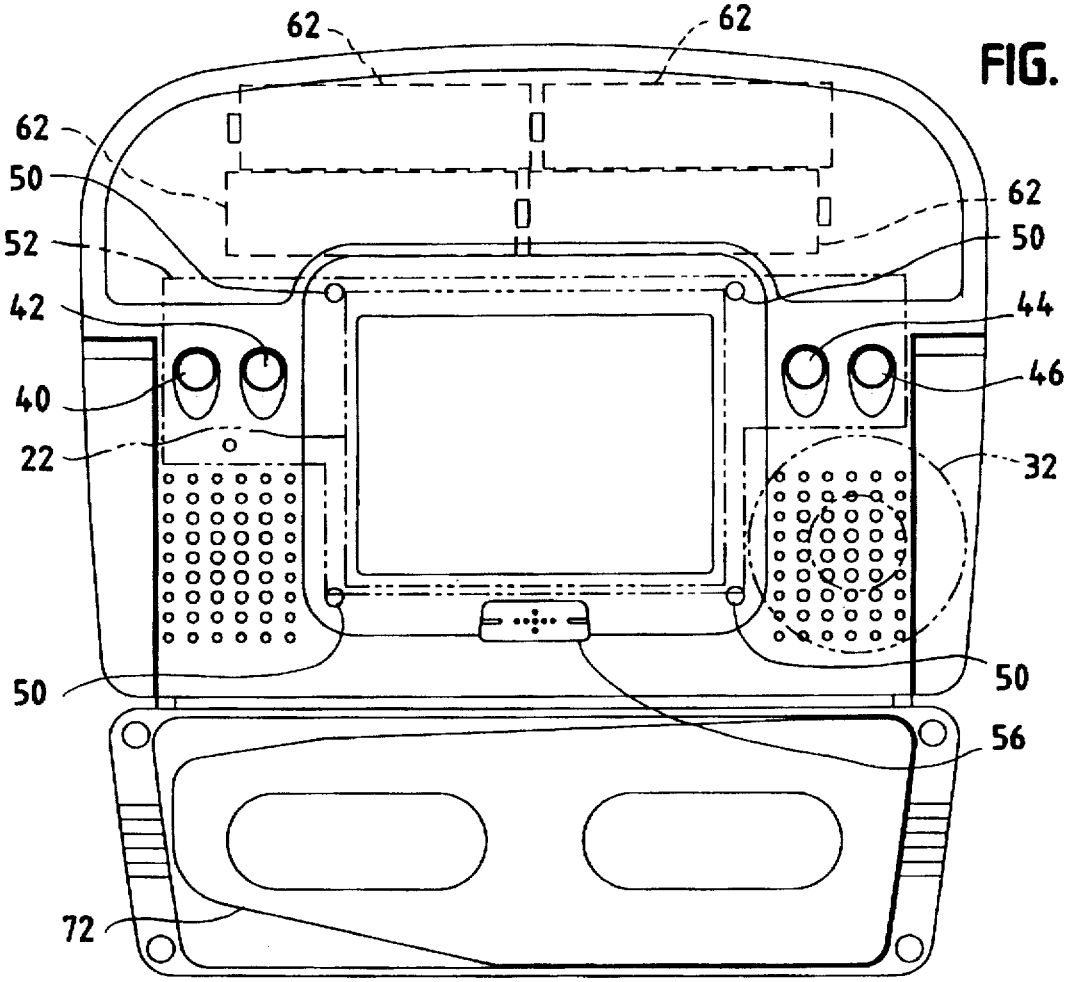
FIG. 2 is a front view of the cabinet of the electronic game of FIG. 1 showing some internal structure in hidden lines.
Figure 4:
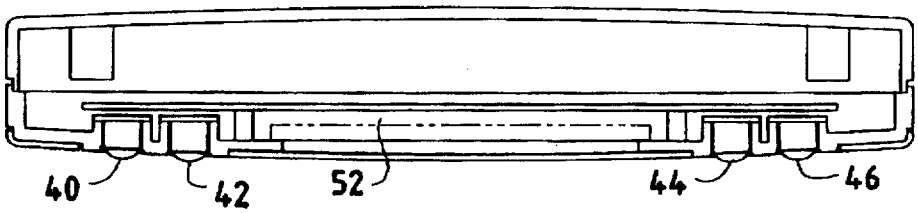
FIG. 4 is a bottom view thereof.
Figure 6:
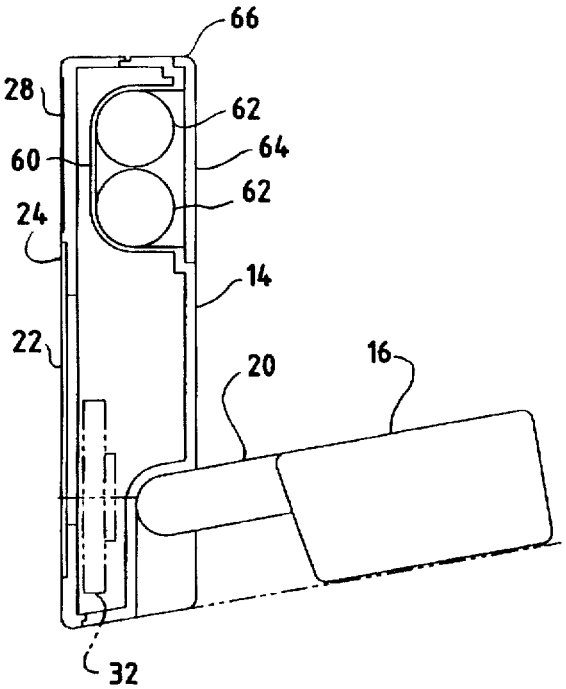
FIG. 6 is a right side view of the cabinet of FIG. 1 in a standing position, taken partially in section.

The preferred embodiment of the inventive electronic game 10 shown in FIGS. 1 and 2, has a cabinet 12 and an emitter gun 70. The cabinet 12 has a target section 14 and a gun storage section 16. The gun storage section 16 houses the emitter gun 70 when the game 10 is not in use, and the gun 70 snaps into and out of a gun pocket 72 in the gun storage section 16. The gun storage section 16 is rotatably mounted by its pivot arm 20 at cabinet pivot 18 (FIG. 6).

The front of the target section 14, as seen in FIG. 1, has at its center a liquid crystal display (LCD) 22 having many possible states. The LCD 22 is preferably about 63 mm wide and 49 mm high, although the viewing area is restricted to about 59 mm across and 43 mm top to bottom. Surrounding the LCD 22 is a frame-shaped, recessed display board 24 which obstructs the frontal view of the LCD 22 along its perimeter.

Figure 5:
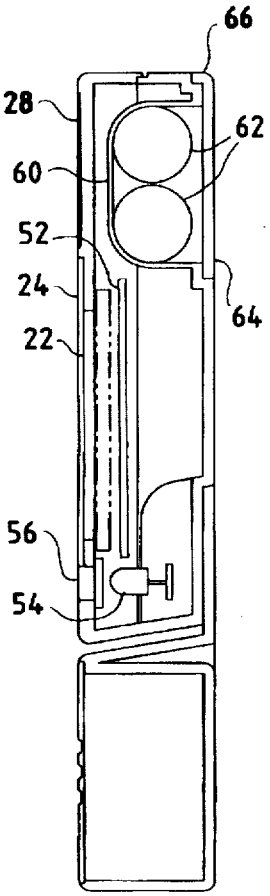
FIG. 5 is a right side view of the cabinet of FIG. 1, taken partially in section.

At each of the four corners of the display board 24, proximate to the hidden corners of the LCD 22 is an infrared light sensor 50. In the preferred embodiment, the infrared sensors 50 are standard photo-transistors, such as the ST-8LR2 or an equivalent. At the base of the display board 24 is a cover 56 for a light emitting diode (LED) 54 (shown in FIG. 5) which permits the LED to be seen from the from view when it is lit during play of the game. The LED 54 is preferably 5 mm.

Figure 7:
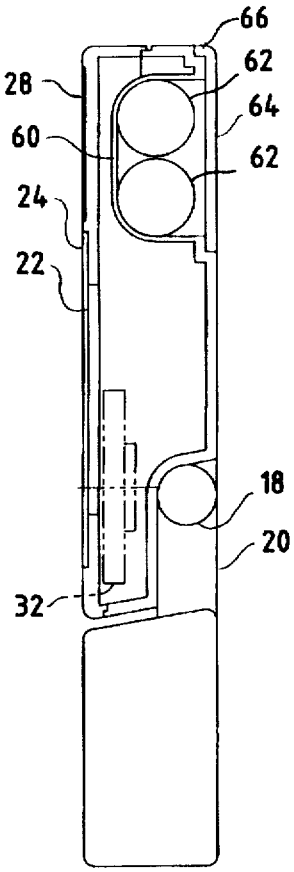
FIG. 7 is a right side view of the cabinet of FIG. 1 in a flat position, taken partially in section.
Figure 8:
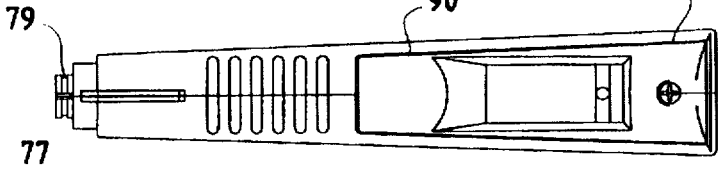
FIG. 8 is a top view of the gun of FIG. 1 with the swing arm in a downward position.
Figure 9:
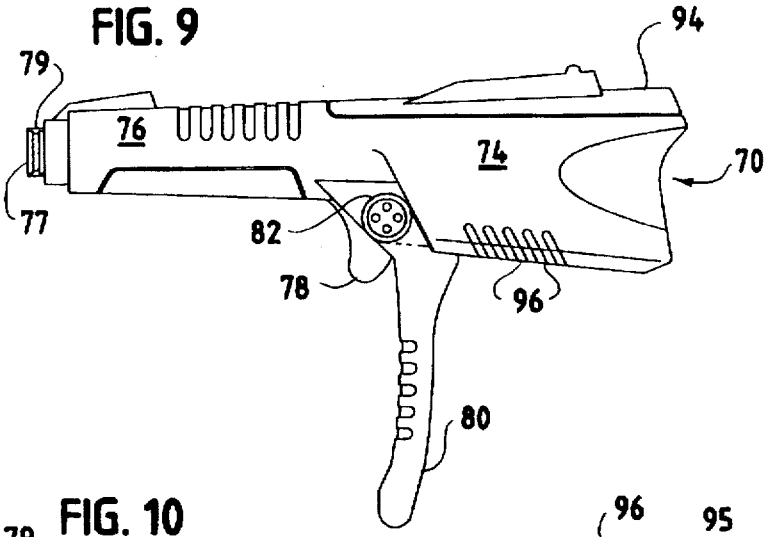
FIG. 9 is a right side view of the gun of FIG. 8.
Figure 10:
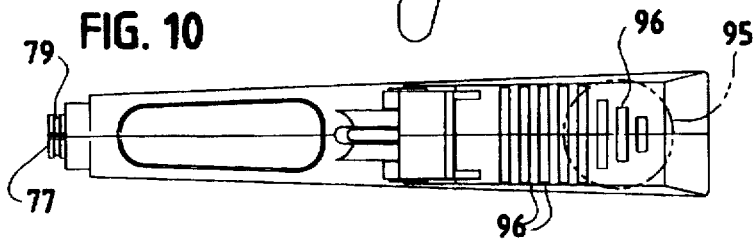
FIG. 10 is a bottom view of the gun of FIG. 8.
Figure 11:
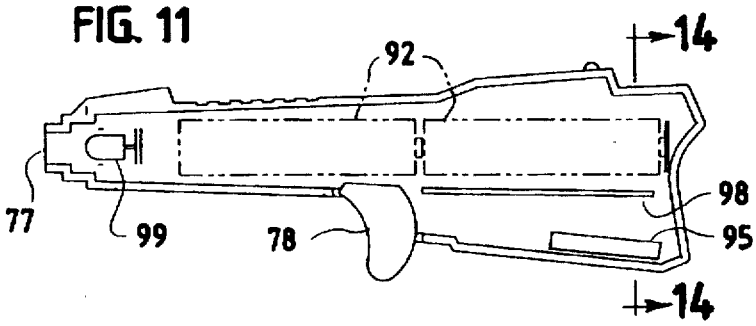
FIG. 11 is a right side view of the gun of FIG. 8 with the swing arm removed, taken partially in section.
Figure 12:
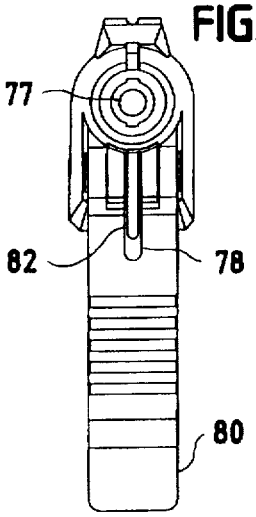
FIG. 12 is a front view of the gun of FIG. 8.
Figure 13:
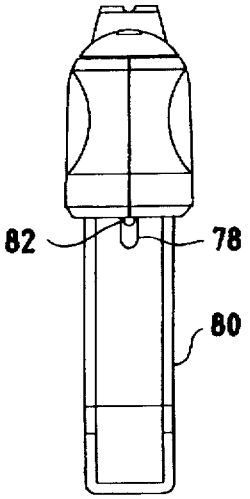
FIG. 13 is a rear view of the gun of FIG. 8.
Figure 14:
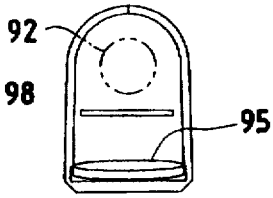
FIG. 14 is a sectional view of the gun of FIG. 11, taken along the line 14—14.

The upper portion of the target section 14 is a flat label recess 28 shaped for the application of an appropriate label, such as one indicating the name of the game played by the electronic game 10. The recess is preferably recessed about 0.5 mm to accommodate a label of appropriate thickness. The sides of the front of the target section 14 have lateral indentations 26. Next to the lateral indentations 26 are speaker holes 30 which form a rectangular array on each side of the display board 24. In the preferred embodiment, the array is nine rows and six columns of substantially circular holes which vary in diameter, generally having larger holes toward the center of the array and small holes toward the perimeter of the array. The array on the right side of FIG. 1 provides an outlet for sounds produced by a target speaker 32 (appearing in FIGS. 2, 6 and 7). The speaker 32 is preferably an 8 ohm speaker of about 36 mm in diameter and 5 mm in depth, and provides approximately 75 dB of sound.

Also present on the front of the target section 14 are four buttons, two on either side of the display board 24. To the left of the display board, are an "on/start" button 40 and an "off" button 42. To the right of the display board, are a "pause" button 44 and a "sound" button 46. The names of the buttons are descriptive of their functions relating to the play of the game 10.

FIG. 2 shows some of the internal components of the target section 14. LCD 22 and speaker 32 are described above. Behind the display board 24, and extending outwardly at its upper end is a single-sided printed circuit board (PCB) 52 having the circuit shown in FIG. 16 connected thereto and which controls the functioning of the target section 14. In particular it receives input signals from the infrared sensors 50 and the buttons 40, 42, 44, and 46 on the front of the target section 14, and it transmits output signals to the various outputs of the game, including the LCD 22, the speaker 32, and LED 56.

FIG. 2 also shows the location of batteries 62 which provide power for the target section 14. Preferably, the target section 14 employs four AA batteries and is oversized by six volts of D.C. Such a voltage will provide a maximum operating current of 70 mA when the game starts. When the game is off, a 5 μA current maintains the game on standby. As seen in FIGS. 3 and 5–7, the battery compartment 60 has a cover 64 along the rear side of the target section 14, and bending around the corner is lip 66.

FIG. 6 shows the cabinet 12 in a standing or folded position. Here, the gun storage section 16 is rotated at the pivot 18 at the end of its pivot arm 20. It is preferably rotated more than 90° so that it supports the target section 14 at an angle to the horizontal so that a player may conveniently play the game with the gun 70 raised above the level of the target section 14, such as where the cabinet 12 is placed on a table, below the eye level of a seated player.

The exploded section of FIG. 1 shows the emitter gun 70 in its storage section 16. To fit into the storage section 16, the gun 70 must have its swing arm 80 in the upward position, touching the bottom of the barrel 76 of the gun 70 near its end. FIGS. 8–14 show the emitter gun 70 with the swing arm 80 in the downward position, substantially perpendicular to the body 74 and barrel 76 of the gun. The swing arm 80 rotates around swing pin 82 to move from one position to the other.

Firing of the gun 70 is accomplished by pressing the trigger 78 in toward the body 74 of the gun 70. The trigger 78 acts as the input for a printed circuit board (PCB) 98 within the gun 70 having the circuit shown in FIG. 15 thereon control the functioning of the gun 70. Specifically, the double-sided gun PCB 98 converts an input signal from the trigger 78 to an output signal for activating infrared light emitting diode (LED) 99 and gun speaker 95.

The infrared LED 99, preferably an IR TX LED (EL-8L) or the equivalent thereof, emits an infrared light beam through an infrared lens 79 and the outlet 77 of the gun 70. The distance between the LED 99 and the outlet 77, as well as the diameter of the outlet 77, determine the angle of projection from the outlet 77 of the gun 70 for the infrared light beam. Preferably, the conical beam projecting from the gun 70 will be 4° in diameter. Thus, the perimeter of the circle projected onto a perpendicular plane will be offset by 2° from the center of the beam.

The gun preferably has two AAA batteries providing approximately three volts D.C. At three volts, the gun has a maximum operating current of about 70 mA while the game starts, and the current is about 5 μA when the gun is on standby (off mode).

Figure 15:
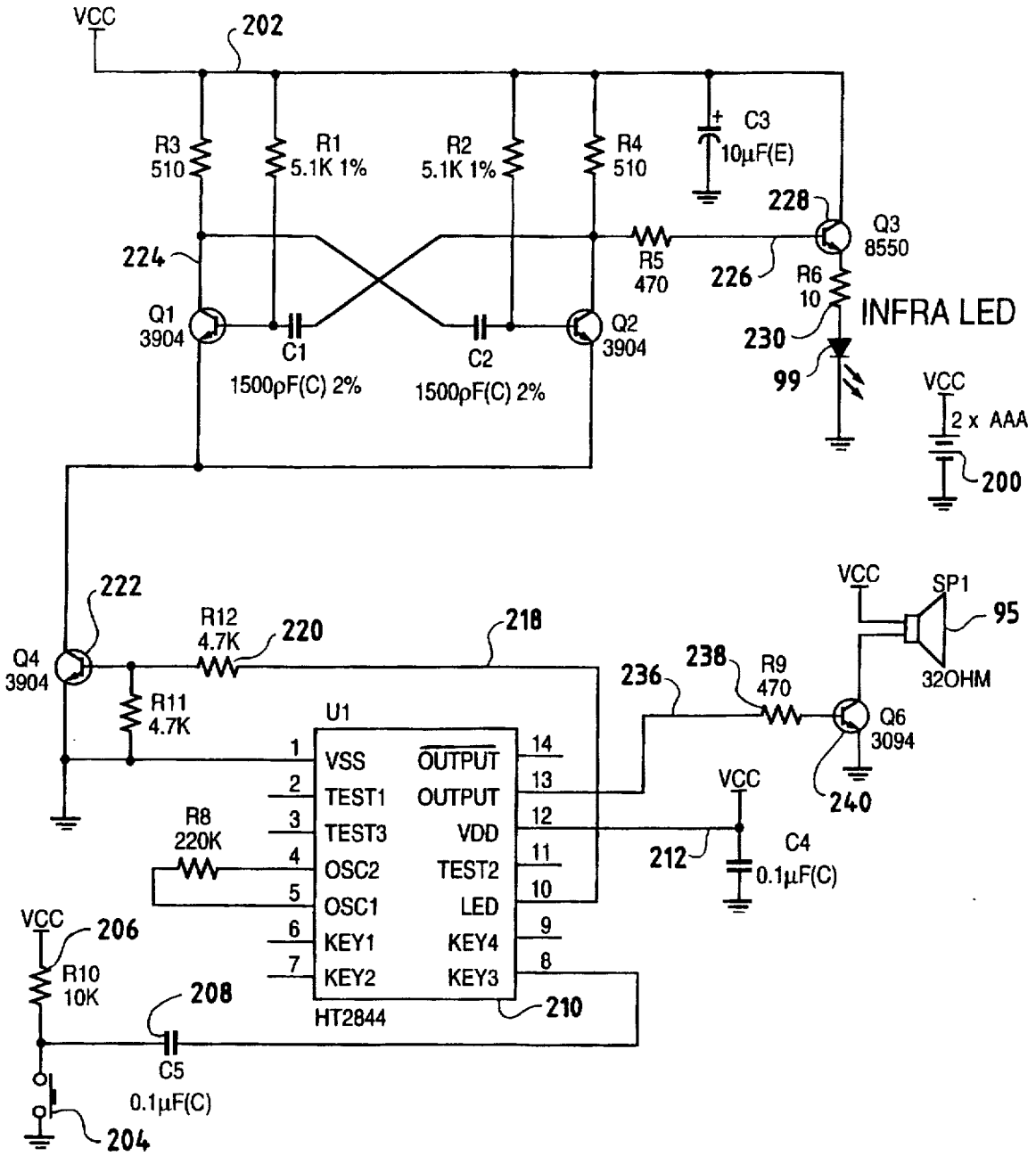
FIG. 15 is a schematic drawing relating to the operation of the gun.

The gun 70 includes a three volt battery operated power supply 200, as seen in FIG. 15, which may be coupled to various other portions of a circuit 202. The circuit 202 includes a trigger switch 204 on the trigger 78 of the gun connected between ground and a resistor 206 connected to receive the three volt potential from the batteries 200. A signal is capacitively coupled through a capacitor 208 through a HT-2844 integrated circuit 210 at its key 3 pin. The integrated circuit is energized from the battery 200 through a lead 212 coupled to its VDD pin and out a lead. In response to the switch 204 being closed, a signal is supplied via a lead 218 through a resistor 220 to an NPN transistor 222 which causes a flip-flop 224 to change state, thereby sending signals through a line 226 to the base of the transistor 228. Those signals are fed through a resistor 230 to an infrared light emitting diode 99 which causes infrared light to be emitted through the lens 79 of the gun. In addition, when the infrared light is emitted, a signal is sent out over a line 236 through a resistor 238 to a transistor 240 which switches a speaker 95 to produce sound.

Figure 16A:
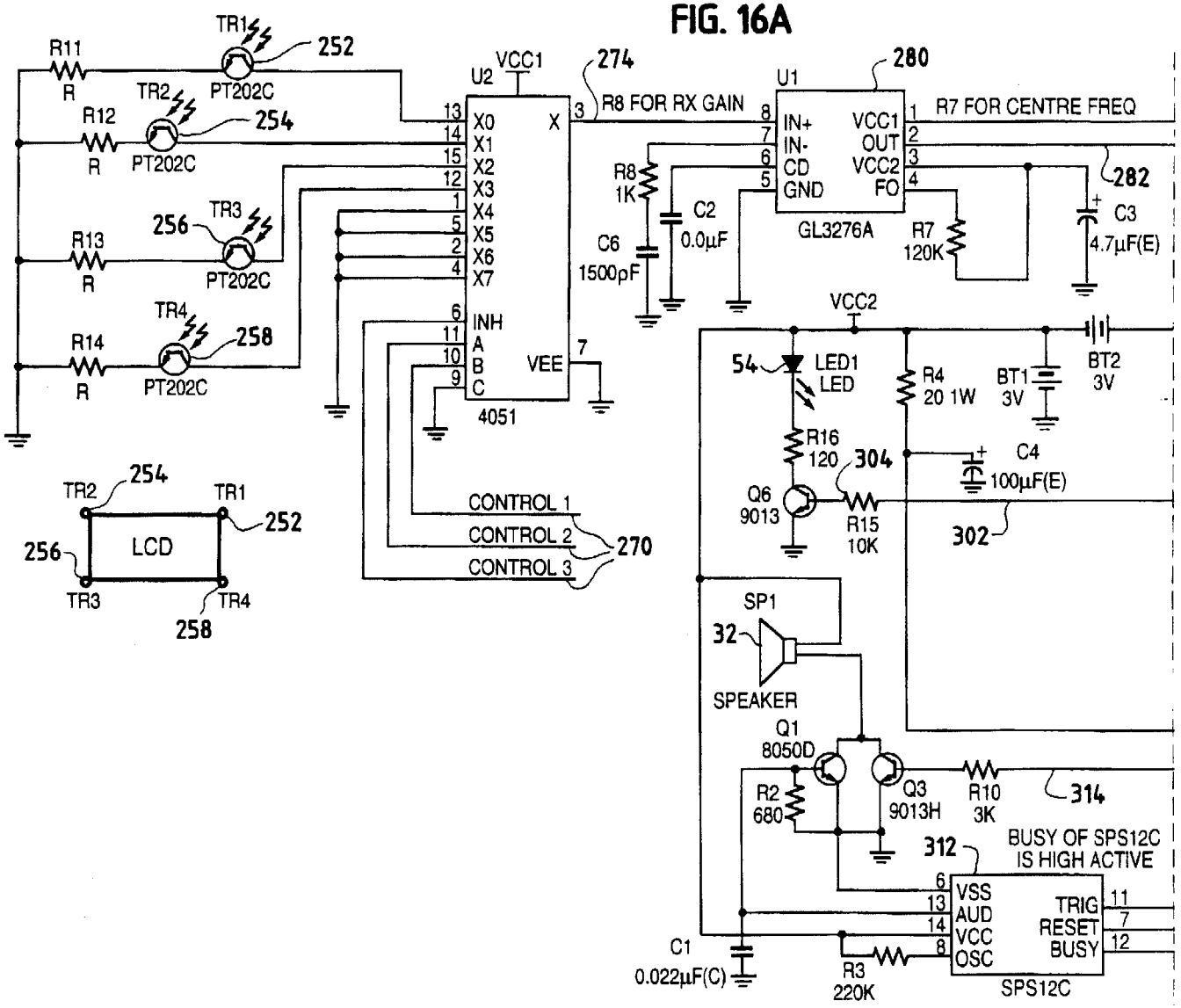
FIG. 16 is a schematic drawing relating to the operation of the target unit.
Figure 16B:
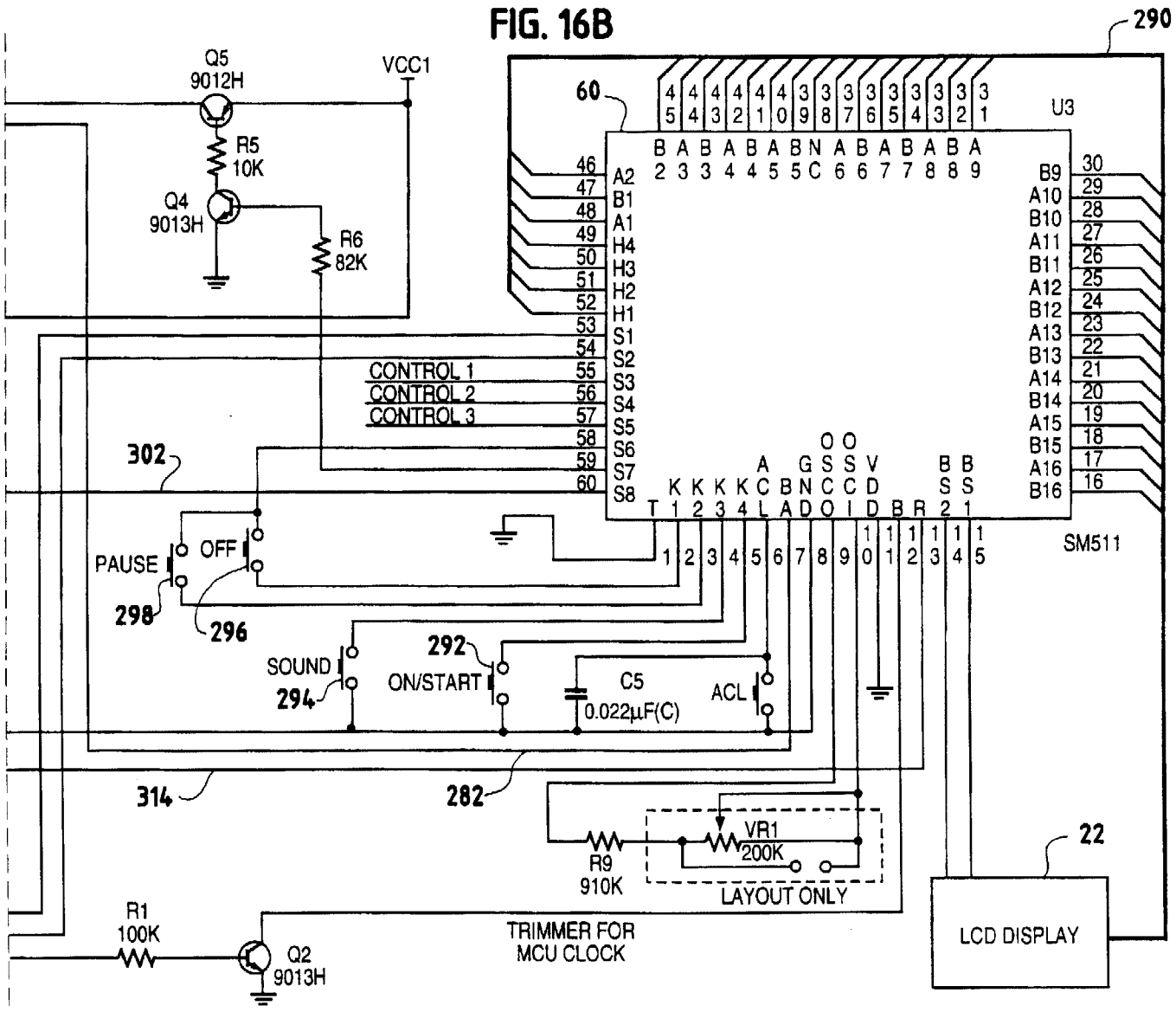

Referring now to FIG. 16, the four input sensors on the panel include phototransistors 252, 254, 256, and 258 which receive light inputs and feed them to a 4051 1-of-8 switch or analog data multiplexer which operates under the control of a plurality of multiplex supply lines 270 driven by an SM-511 micro-controller 272. Lines 270 cause one of the signals to be selected at a time and fed out over a line 274 to a GL3276A voltage to frequency converter 280 which produces an output on a line which output is fed to a BA pin of the microcontroller 272. The microcontroller 272 also drives the LCD display through a bus 290 and may be switched on and off by an on/off switch 292, may generate sound in response to a sound switch 294, may be switched off by an off switch 296 or may be paused by a switch 298. Hits or other output signals may be indicated by signals sent on a line 302 through a resistor 304 which controls the transistor 306 to control the light output from an LED 54. A speaker 32 may also provide an audio output indication driven by an integrated circuit 312 and controlled over a line 314 from the microcontroller 272.

In the preferred embodiment of the invention, the LCD presents targets at various times in four quadrants of the display 22. Each quadrant corresponds to one of the infrared sensors 50. Thus, when an IR beam is emitted from the gun 70, whichever sensor 50 registers a measurement of IR light or, if more than one sensor registers a measurement, whichever sensor 50 registers the strongest measurement of IR light, the quadrant of the LCD corresponding to that sensor 50 is "hit." If there is a target in that quadrant of the LCD at the time of firing, a "hit" is registered, and the microcontroller 60 causes appropriate outputs such as a sound a change in the state of the LCD. If there is no target when the gun is fired, a "miss" is registered, and the microcontroller 60 causes different sounds and/or changes in the state of the LCD. For optimal performance in the preferred embodiment, the gun should preferably be held from about 0.5 to 3 feet from the LCD 22 and infrared sensors 50.

Figure 17:
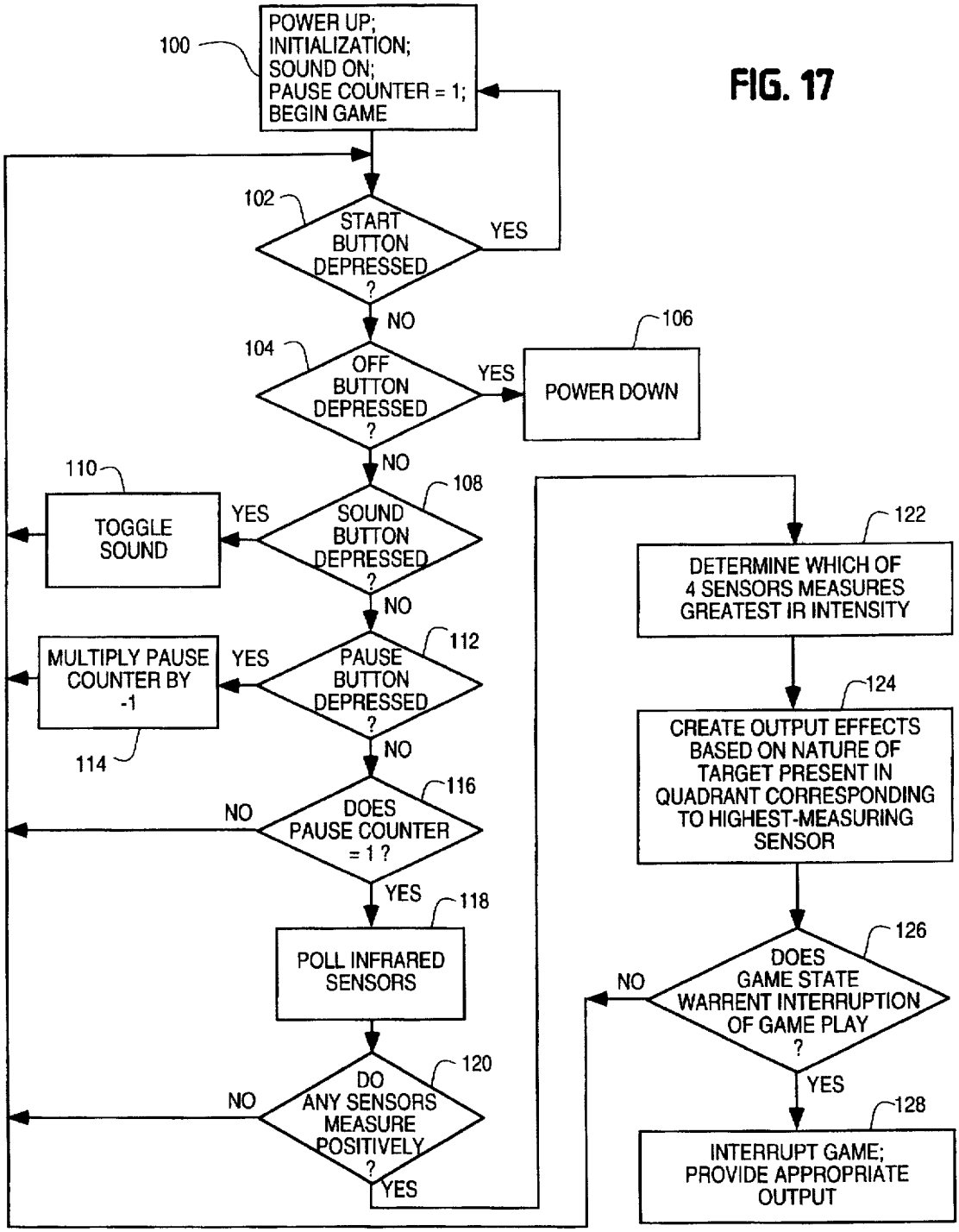
FIG. 17 is a flow chart relating to the described game.

FIG. 17 is a flow chart relating the general functioning of the microcontroller 60 during play of the preferred embodiment of the game. When the game is turned on by depressing the on/start button 40, step 100 powers up the game and initializes certain parameters. Specifically, the sound is turned on, the pause counter is set to 1, and the visual player targets displayed in the four quadrants of the LCD first appear. The controller then begins a loop of repeatedly polling for button and sensor inputs.

The controller first checks the start button in step 102. If the start button 40 is depressed, the controller returns to step 100 and reinitializes the game. If the start button 40 is not depressed, the controller next polls the off button 42 in step 104. If the off button 42 is depressed, the game powers down to its off state in step 106. If the off button is not depressed, the controller then checks the sound button 46 in step 108. If the sound button is depressed, the controller toggles the sound to off or on, depending on its present state, in step 110, before returning to step 102, the beginning of the polling loop. If the sound button is not depressed, the controller then polls the pause button 44 in step 112. If the pause button is depressed, the pause counter is multiplied by (−1) such that the pause counter toggles between a state of 1 and (−1) as the pause button is repeatedly depressed. Because the pause loop cycles back to step 102, the player can restart the game, turn the game off or toggle the sound while the game is paused.

If the game is not paused, the controller then performs a poll of the four infrared sensors 50 in step 118 and determines whether any infrared sensors detect light from the emitting gun in step 120. If none of the sensors 50 measures any light from the emitting gun, the controller cycles back up to step 102 and begins the polling loop anew. If one or more of the sensors 50 detect such light, the controller determines which of the four sensors 50 detected the strongest signal in step 122. Based on this determination, the controller then creates output effects in step 124 based on the nature of the target that was present in the quadrant of the LCD corresponding to the sensor detecting the strongest signal. The controller then determines in step 126 whether the game has arrived at a state where it should interrupt game play, such as the end of the game, or moving from one stage of a game to the next stage. If the game has not arrived at such a point, the controller returns to step 102 and begins the polling loop again. If an interrupt state has been reached, the controller interrupts the game (step 128) and provides whatever outputs are appropriate at that phase of the game.

Many different types of games may be played with the claimed invention. One type of game is where the player plays the role of a police officer whose mission is to rescue hostages being held by a number of criminals. The player is rewarded for shooting criminals and punished for inadvertently (or intentionally) shooting hostages. While the player is trying to shoot the criminals, they simultaneously shoot at him. When the player gets shot, he loses energy, and if he loses all his energy, he dies.

Occasionally gun icons may appear on the LCD. If the player successfully shoots at such an icon, he may obtain an upgrade in the type of gun he is using. Various types of guns have different properties. Some can be reloaded; others cannot. Some have larger ammunition clips than other. Some can shoot through barricades; others cannot. Occasionally life-up icons may appear on the LCD. If the player successfully shoots at such an icon, his energy is completely restored. If the player dies 3 times before completing any of the nine stages of the game, the game is over. If he completes all nine stages, he wins the game.

Another type of game which may be played is where the player attempts to shoot alien spaceships during intermittent intervals when the shields of the spaceship are inactive. After a certain amount of time, the aliens repair their shields and the player is defenseless against their assault, so the player must destroy the ships while their shields are faulty. There are nine stages in this game also, and the alien spaceships form increasingly more complex attack patterns in sequential stages.

A third type of game which may be played is where the player is a member of a paramilitary group which must penetrate the security of a top secret military base and detonate a nuclear device on sub-level 3 of a control complex. The player must avoid being hit by armed helicopters, missiles, explosions, deadly aliens, zombies and the like. The player may discover hidden weapons, such as grenades, shotguns, and machine guns, he can use to his benefit along the way. This type of game has six stages, each at a different section of the military base.

Obviously, the inventive game has numerous other applications, and the three examples described above are merely illustrative of the types of games that are perceived to be heavily demanded.

In the preferred embodiment, the target section 14 is approximately 150 mm wide by 155 mm tall by 25 mm deep. The gun 70 is approximately 118 mm wide and 23 mm deep. With the swing arm 80 in the downward position, the gun 70 is approximately 84 mm tall; when the arm 80 is in the upward position, the gun 70 is approximately 38 mm tall.

The description of preferred embodiments is not meant to limit the scope of the invention to the embodiments described herein. On the contrary, many other possible embodiments of the claimed invention could be made.

What is claimed is:

1. An electronic game comprising:

an emitter unit for emitting a directed beam of electromagnetic radiation; and a target unit comprising:

a display partitioned into multiple target areas for displaying a target viewable within at least one of said multiple target areas; and multiple electromagnetic radiation sensors along the periphery of said display, each of said sensors being associated respectively with one of said multiple target areas of said display for detecting said directed beam of electromagnetic radiation at the one of said multiple target areas associated therewith;

said display having a plurality of display states viewable within at least one of said multiple target areas responsive to said directed beam of electromagnetic radiation when said emitter unit projects said directed beam of electromagnetic radiation onto the sensor associated respectively with the target area at which the emitter unit is directed, a poll of said multiple electromagnetic radiation sensors determining whether any of said sensors detect said directed beam of electromagnetic radiation at associated multiple target areas of said display, wherein a hit detection signal is generated in response to said poll determination of the sensor corresponding to the target area which detects said directed beam of electromagnetic radiation thereat generally measuring more electromagnetic radiation than others of said multiple target areas.

2. A game in accordance with claim 1 wherein said display comprises a liquid crystal display.

3. A game in accordance with claim 2 wherein said emitter unit comprises one or more infrared light emitting diodes for emitting a directed beam of infrared light, said multiple electromagnetic radiation sensors each comprising one or more photo-transistors detecting infrared light.

4. A game in accordance with claim 3 wherein said emitter unit comprises simulation of a projectile-emitting weapon such as a gun, a bazooka or the like for emitting a directed beam of infrared light.

5. A game in accordance with claim 4 wherein said multiple target areas comprise quadrants of said liquid crystal display.

6. A game in accordance with claim 5 wherein said multiple electromagnetic radiation sensors comprise at least four of said sensors near the corners at the periphery of said display each of said sensors being associated respectively with one of said quadrants of said display for detecting said directed beam of electromagnetic radiation at the one of said quadrants associated therewith when said emitter unit aimed at said one of said quadrants emits infrared light.

* * * * *